US006515557B1

(12) United States Patent
Wangsvick et al.

(10) Patent No.: US 6,515,557 B1
(45) Date of Patent: Feb. 4, 2003

(54) ISOLATING SIGNAL DIVIDER/COMBINER AND METHOD OF COMBINING SIGNALS OF FIRST AND SECOND FREQUENCIES

(75) Inventors: Chad M. Wangsvick, Tucson, AZ (US); Gary M. Salvail, Tucson, AZ (US); Mark E. Kusbel, Tucson, AZ (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 09/929,189

(22) Filed: Aug. 13, 2001

(51) Int. Cl.[7] ..... H01P 5/12

(52) U.S. Cl. ..... 333/126; 333/117; 333/128; 333/129; 333/132; 333/134; 333/136; 343/858; 343/700; 343/852; 343/853; 343/860

(58) Field of Search ..... 333/126, 128, 333/129, 132, 134, 136; 343/858, 700, 853, 860

(56) References Cited

U.S. PATENT DOCUMENTS 3,999,151 A * 12/1976 Baldwin et al. ..... 333/114
4,317,216 A * 2/1982 Kaegebein ..... 333/202
6,307,525 B1 * 10/2001 Bateman et al. ..... 333/126
6,342,867 B1 * 1/2002 Bell ..... 343/795

* cited by examiner

*Primary Examiner*—Michael Tokar
*Assistant Examiner*—Linh Van Nguyen
(74) *Attorney, Agent, or Firm*—Colin M. Raufer; Leonard A. Alkov; Glenn H. Lenzen, Jr.

(57) ABSTRACT

A signal divider/combiner (11) and method combines first and second frequency signals received by microstrip patch antennas (58, 48). A first transmission line stub (28) blocks the second frequency signals on the first signal receiving path, and a second transmission line stub (20) blocks the first frequency signals on the second signal receiving path providing increased signal levels at a receiver input (10). In one embodiment, the transmission line stubs are open-circuit stubs and are positioned a quarter-wavelength from a combining junction (12) formed from stripline transmission lines (14, 32, 50). The transmission line stubs (28, 20) also reduce radiation of the first frequency signal by the second antenna as well as radiation of the second frequency signal by the first antenna. In one embodiment, the first and second frequency signals are the L1 and L2 signals provided by the Global Positioning System.

22 Claims, 2 Drawing Sheets

ISOLATING SIGNAL DIVIDER/COMBINER AND METHOD OF COMBINING SIGNALS OF FIRST AND SECOND FREQUENCIES

FIELD OF THE INVENTION

This invention relates in general to the field of microwave circuits, in particular to microwave divider/combiner circuits that divide/combine received signals of differing frequency, and more particularly to antenna systems that receive Global Positioning System (GPS) L1 and L2 frequency signals.

BACKGROUND OF THE INVENTION

Microwave power dividers and combiners have been used in a wide variety of applications for many years and in their most basic form are three port devices. In the case of a power divider, one port is often referred to as an input port and the other ports are often referred to as the output ports. In the case of a power combiner, one port is often referred to as an output port and the other ports are often referred to as the input ports. Passive microwave power dividers and combiners generally operate as either a power combiner or power divider, and therefore whether the ports are referred to as input or output ports is interchangeable. In many applications, power divider/combiners operate as both a combiner and a divider, for example, when used in a beamforming network for a phased array antenna that operates as both a transmit and receive antenna.

Microwave power dividers and combiners may use microwave transmission lines such as stripline transmission lines or microstrip transmission lines. A microwave stripline transmission line is comprised of three conductors wherein a center conductor is provided between two layers of dielectric material which may lie between two ground-plane conductors. A microstrip transmission line on the other hand often has a conductor fabricated on a layer of dielectric material and a ground plane conductor on an opposite side of the dielectric material.

In many microwave signal applications it is desirable to be able to split microwave signals into one or more signals. A signal divider often takes the form of a distributed quarter-wavelength section of transmission line in a "Tee" configuration. The signal power is split into two components; one output at each of two output ports. In addition to splitting microwave signals, it is frequently desirable to be able to combine two microwave frequencies to a single port. For example, two antenna inputs may be combined to provide a single input to a receiver. Like signal dividers, combiners often employ two or more quarter-wavelength sections coupled together at a common junction to combine two microwave signals.

A problem with conventional signal dividers and signal combiners and especially dividers and combiners that utilize quarter-wavelength sections is their inability to efficiently combine and/or divide signals of different frequencies. For example, when two antennas receive separate frequencies that need to be combined into a single receiver input, combining the signals can result in up to a 50% loss in received power from each signal because the signal power is split between the receiver input and the output from the other antenna. This not only reduces receiver performance, but may result in radiation of the received signals through the other antenna. Receiver performance is especially important to systems that utilize timing measurements for the basis of determining position. For example, receivers in advanced missile position determining systems may acquire and track signals provided the Global Positioning System (GPS) system satellites.

Accordingly, there is a general need for a method and apparatus that provides for improved position determination in missile systems. There is also a general need for a method and apparatus that provides for improved receiver performance. There is also a general need for a method and apparatus that provides improved signal strength of received signals to a receiver. There is also a general need for a method and apparatus that reduces radiation of received signals by other antennas. There is also a general need for a signal combiner and method of combining signals that more efficiently combines signals of different frequencies. There is also a general need for a method and apparatus for dividing signals and more efficiently separating signals of different frequencies. There is also a general need for divider/combiner structures for use with signals of different frequencies.

SUMMARY OF THE INVENTION

The needs in the art are addressed by the present invention which, in one embodiment, provides a signal divider/combiner for dividing/combining signals of a first and second frequency. In this one embodiment, the signal divider/combiner includes first, second and third transmission lines meeting at a junction, a first transmission line stub section coupled to the first transmission line to block signals of the second frequency along the first transmission line, and a second transmission line stub section coupled to the second transmission line to block signals of the first frequency along the second transmission line. In this embodiment, the first transmission line stub section is a first open-circuit stub positioned a first distance from the junction. The first distance is substantially equal to a quarter-wavelength of the second frequency. The second transmission line stub section is a second open-circuit stub positioned a second distance from the junction. The second distance is substantially equal to a quarter-wavelength of the first frequency. In this embodiment, the first, second and third transmission lines and the first and second open-circuit stubs are microstrip transmission lines having substantially the same impedance, and the first frequency is a Global Positioning System (GPS) L1 frequency, and the second frequency is a GPS L2 frequency.

BRIEF DESCRIPTION OF THE DRAWINGS

The invention is pointed out with particularity in the appended claims. However, a more complete understanding of the present invention may be derived by referring to the detailed description and claims when considered in connection with the figures, wherein like reference numbers refer to similar items throughout the figures and:

Figure 1:
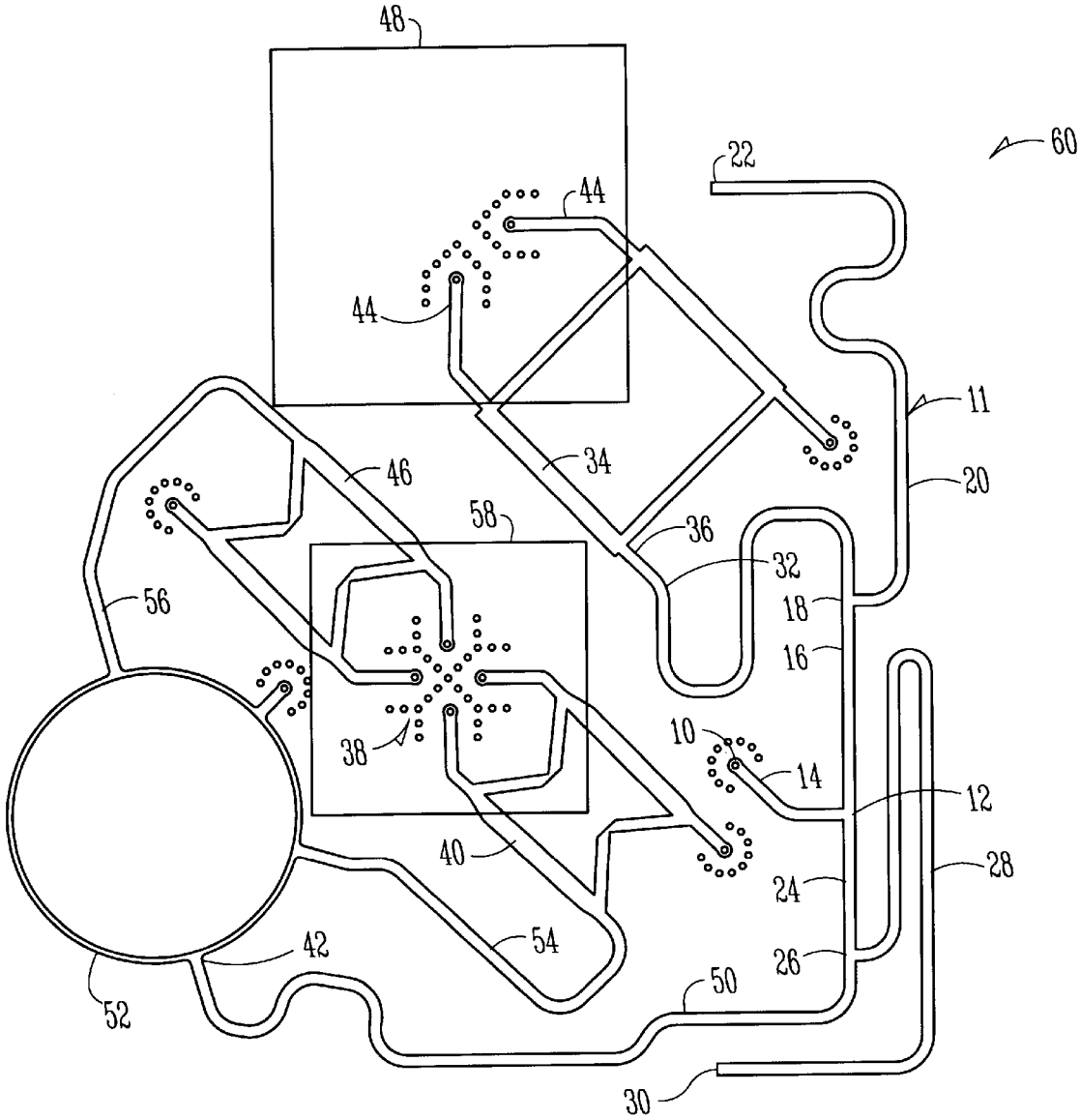
FIG. 1 shows an example circuit layout of an antenna receiving system including a signal divider/combiner in accordance with one embodiment of the present invention.

The description set out herein illustrates the various embodiments of the invention in one form thereof, and such description is not intended to be construed as limiting in any manner.

DETAILED DESCRIPTION OF THE DRAWINGS

The present invention relates to divider/combiner structures and methods for dividing/combining signals of different frequencies and provides, in one of the embodiments, a method and apparatus for improved position determination. The present invention also provides, in another embodiment, a method and system with improved signal levels at a position determining receiver. In other embodiments, the present invention provides signal dividers, signal combiners and methods of efficiently dividing and/or combining signals of different frequencies. In another embodiment, the present invention provides an antenna receiving system for receiving first and second frequency signals. In yet another embodiment, the present invention provides a method of reducing radiation of signals received through first and second antenna outputs.

The various embodiments of the present invention are suitable for use in systems that require the combining of two or more frequencies for a single receiver input, or alternatively, systems that require the separation of two or more frequencies for transmission by separate antennas. The present invention is applicable to any stationary or moving device that uses two signals, including such devices that use two signals to determine its position. For example, the present invention is applicable to handheld GPS receivers as well as to position determining systems on board missiles that may utilize GPS-type timing measurements as a basis for determining position and for navigation.

In accordance with one of the embodiments of the present invention, a signal divider/combiner for dividing/combining signals of a first and second frequency comprises first, second and third transmission lines having substantially the same impedance and meeting at a junction. A first open-circuit stub is coupled to the first transmission line and serves to block signals of the second frequency along the first transmission line. A second open-circuit stub is coupled to the second transmission line and serves to block signals of the first frequency along the second transmission line. Traditional power divider/combiners, on the other hand, often power combine signals of the same frequency received from two input ports, or power divide signals of the same frequency among two output ports. In other words, traditional power dividers split the received power of a signal between two or more output ports resulting in about one-half (or less) of the signal's energy at each output port. Alternatively, traditional power combiners combine the energy of signals received from two or more input ports and provide a signal at a third port of a power level that is the sum of the power levels received at the input ports.

The signal divider/combiner of present invention, unlike traditional power divider/combiners, does not necessarily intend to combine the power of two or more signals of the same frequency to one output, nor does the signal divider/combiner of the present invention necessarily intend to divide the power of single frequency signals among two or more outputs. The present invention is intended to transfer a substantial portion of the energy of different frequency signals to a single output, or alternatively separate a substantial portion of the energy of different frequency signals. Although the present invention has numerous applications, it is most applicable for use in stationary or moving devices that use two or more different frequency signals, such as devices that use two or more signals to determine its position or derive timing references. Examples of such systems that provide signals for position determination include, for example, the Global Positioning System ("GPS") provided by the United States, the Global Navigation System ("GLONASS") provided by the (former) Union of Soviet Socialist Republics, and various telecommunication systems transmitting global positioning type signals.

The GPS is a positioning system comprising satellite signal transmitters that transmit information from which a receiver can determine present location on or adjacent to the Earth's surface, as well as make timing measurements such as standard time-of-day or time of observation measurements. The GPS includes up to 24 earth-orbiting satellites that move with time relative to the surface of Earth. The satellites transmit right hand circularly-polarized signals at two carrier frequencies; L1 at 1575 MHz and L2 at 1227 MHz. The carrier frequencies are modulated by navigation data and by ranging codes. The ranging codes are spread spectrum codes having a unique pseudorandom noise sequence associated with each satellite. With the navigation data, a receiver may determine the satellite's location at the time of signal transmission and, with the ranging codes, the receiver determines time and the satellite-to-receiver range and velocity.

In particular, the navigation data includes updated information on the satellite's orbit so that a GPS-type receiver can accurately determine satellite location. To utilize the ranging codes, the receiver replicates the pseudorandom noise sequence of a received signal and time shifts this sequence in a code tracking loop until it correlates with the received sequence. The required time shift is indicative of the distance between the receiver and that satellite. Often, a receiver may also determine its velocity by processing carrier phase in a carrier tracking loop to detect Doppler frequency shifts and thereby, the receiver-to-satellite velocity.

There are two types of pseudo random noise ranging codes transmitted from the GPS satellites. The first code is the course/acquisition code (C/A code), sometimes referred to as the civilian code, which is the standard GPS code and modulates the L1 signal. The second code is the precise code (P-code) which modulates both the L1 and L2 signals and is used primarily to provide more accuracy in position determinations than can usually be obtained through the use of the C/A code. The P-code is primarily used for government and military applications.

Signal acquisition and tracking of the GPS signals becomes more difficult, however, when the receiver is subjected to interference signals. These signals can be unintentional (e.g., radio, television and radar transmissions) or intentional (e.g., wideband-Gaussian and spread spectrum jammer signals and narrow-band swept jammer signals). A receiver in a missile position determining system that uses both the GPS L1 and L2 signals, for example, may be threatened by intentional jammers whose interference signals result in receiver failure or unreliable tracking (e.g., missing synchronization in the code tracking loop). Therefore, it is highly desirable to efficiently provide the highest signal levels of the GPS L1 and L2 signals to the receiver as possible.

FIG. 1 shows an example circuit layout of an antenna receiving system including a signal divider/combiner in accordance with one embodiment of the present invention. Although antenna receiving system 60 is suitable for receiving GPS L1 and L2 signals, those of skill in the art will appreciate that system 60 is equally suitable for receiving other frequency signals with appropriate frequency design modifications. In accordance with one embodiment, signals of a first frequency received by first patch antenna 58 are combined with signals of a second frequency received by second patch antenna 48 and provided to a receiving device such as a receiver through receiver input 10.

First patch antenna 58 has a plurality of outputs 38 which provide signals of the first frequency in various phase relationships. In the example illustrated, there are four antenna outputs that provide four signals, each having a certain phase relationship to the other. In accordance with one embodiment, first patch antenna 58 receives a narrow range of frequencies, preferably not receiving frequencies that second patch antenna 48 is designed to receive. The outputs from first patch antenna 58 are coupled to hybrids 40, 46 which perform in-phase signal combining and provide signals of the first frequency respectively on transmission line sections 54, 56. Hybrids 40, 46 are preferably ninety-degree hybrids, although other elements for combining signals may be equally suitable for use with the present invention.

The signals of the first frequency provided on transmission line sections 54, 56 are combined in phase through transmission line ring 52. In accordance with one embodiment of the present invention, transmission line ring 52 is a one hundred eighty degree hybrid ring which may have ports separated in phase by ninety degrees. For example, transmission line section 56 provides signals at a first port of the ring, and second port 51 is ninety degrees in phase at the first frequency from the first port. Transmission line section 54 provides signals to a third port which is ninety degrees from second port 51, and fourth port 42 is provided another ninety degrees from the third port. Desirably, signals of the first frequency from transmission line sections 54, 56 are combined substantially in-phase at fourth port 42. Fourth port 42 may be viewed as an antenna output for all signals of the first frequency provided by first patch antenna 58. The combined signals of the first frequency at antenna output 42 are provided to an input port of signal divider/combiner 11.

Second patch antenna 48 has a plurality of outputs 44 which provide signals of the second frequency in various phase relationships. In the example illustrated, there are two antenna outputs 44 that may, for example, provide two signals, each having a known phase relationship to the other. In accordance with one embodiment, second patch antenna 48 receives a narrow range of frequencies, preferably not receiving frequencies that first patch antenna 58 is designed to receive. The outputs from second patch antenna 48 are coupled to hybrid 34 which performs in-phase signal combining and provides signals of the second frequency respectively on second transmission line section 32 at output port 36. Hybrid 34 is preferably a ninety-degree hybrid, although other elements for combining signals may be equally suitable for use with the present invention. The combined signals of the second frequency at second antenna output 36 are provided to a second input port of signal divider/combiner 11.

Signal divider/combiner 11 comprises first and second transmission line sections 50, 32 coupled with a third transmission line section 14 at junction 12. Signal divider/combiner 11 also comprises first and second transmission line stub sections 28, 20 coupled respectively to first and second transmission line sections 50, 32. In one embodiment of the present invention, first and second transmission line sections 50, 32 serve as inputs of a signal combiner with transmission line section 14 providing an output. In another embodiment of the present invention, transmission line section 14 serves as an input of a signal divider with first and second transmission line sections 50, 32 serving as the outputs.

In accordance with one embodiment, the signals of the first frequency provided at first antenna output 42 travel along first transmission line section 50, while signals of the second frequency provided at second antenna output 36 travel along second transmission line section 32. First transmission line section 50 and second transmission line section 32 meet at signal combining junction 12. Transmission line section 14 is coupled to the first and second transmission line sections at junction 12 and provides a signal comprised of the first and second frequencies to system input 10. System input 10 can include, for example, an input to a receiver, such as a GPS type receiver, that processes the received signals.

First transmission line stub section 28 is coupled to first transmission line section 50 to block signals of the second frequency on first transmission line section 50. Second transmission line stub section 20 is coupled to second transmission line section 32 to block signals of the first frequency on second transmission line section 32. In accordance with one embodiment, first transmission stub section 28 is positioned at stub junction 26 located distance 24 from junction 12 substantially equal to a quarter-wavelength of the second frequency. Second transmission line stub section 20 is positioned at stub junction 18 located distance 16 from junction 12 substantially equal to a quarter-wavelength of the first frequency.

In accordance with one of the embodiments, first and second transmission line stub sections 28, 20 are open-circuit transmission lines having an open-circuit at first and second ends 30, 22. In this embodiment, first transmission line stub section 28 has a length equal to an odd number of quarter-wavelengths of the second frequency, while second transmission line stub section 20 has a length equal to an odd number of quarter-wavelengths of the first frequency. The number of quarter-wavelengths used for the length of the transmission line stub sections is determined based on several factors including, for example, the frequency range of the signals to be blocked and tolerances of the transmission lines. In general, the longer the transmission line stub section, the higher the "Q" of the circuit and the more narrow the range of signal that is blocked. The open-circuited transmission lines provide an "open-circuit" for the blocked frequency at junction 12. In other words, the open-circuit end of first transmission line stub section 28 provides what appears as an open-circuit to signals of the second frequency provided along second transmission line section 32 at junction 12. Accordingly, signals of the second frequency from second transmission line section 32 are substantially diverted to transmission line section 14 and refrain from substantially traversing onto transmission line section 50. Additionally, the open-circuit end of second transmission line stub section 20 provides what appears as an open-circuit to signals of the first frequency from first transmission line section 50 at junction 12. Accordingly, signals of the first frequency provided along first transmission line section 50 are substantially diverted to transmission line section 14 and refrain from substantially traversing onto transmission line section 32.

In accordance with an alternate embodiment of the present invention, first and second transmission line stub sections 28, 20 may be short-circuit transmission lines having a RF short-circuit at first and second ends 30, 22. In this embodiment, first transmission line stub section 28 has a short-circuit end at the second frequency and second transmission line stub section 20 has a short 30 circuit end at the second frequency. In this alternate embodiment, the length of first and second transmission line stubs 28, 20 is selected to achieve an open circuit condition for the proper frequency at junction 12.

Because signals of the first frequency are blocked on transmission line section 32, a substantial portion of the signals' energy is provided from transmission line section 50 to transmission line section 14. In this way, signals of the first frequency "see" junction 12 as a bend or "corner" and do not "see" transmission line section 32. Furthermore, because signals of the second frequency are blocked on transmission line section 50, a substantial portion of the energy of these signals is provided from transmission line section 32 to transmission line section 14. In this way, signals of the second frequency also "see" junction 12 as a bend or "corner" and do not "see" transmission line section 50.

In accordance with one embodiment of the present invention, the transmission lines are stripline transmission lines fabricated on a dielectric substrate such as Duroid or alumina, although microstrip transmission lines are equally suitable. In one embodiment, junction 12, is a "tee" junction like that illustrated in FIG. 1, and in another embodiment, junction 12 may be a "y" type junction where transmission line sections 50, 32 couple with transmission line 14 at various angles other than, for example, a ninety-degree angle.

In accordance with one of the embodiments of the present invention, the impedance of each transmission line 14, 50 and 32 is substantially the same at junction 12. The impedance of transmission lines 14, 50 and 32, as well as the impedance of transmission line stub sections 20, 28, may range anywhere between 10 and 300 ohms depending on circuit tolerances for practical line widths; however, impedances in the range of 40 to 100 ohms are preferred.

Traditional power divider/combiners, on the other hand, often have different impedances on some of their legs and use quarter-wave transformer sections to perform impedance matching. The present invention, unlike traditional power combiners, does not intend to combine the power of two signals of the same frequency to one output, nor does the present invention intend to divide the power of single frequency signals among two outputs. The present invention, when operating as a signal combiner, is intended to transfer substantially all the energy of different frequency signals to a single output, or alternatively, when operating as a signal divider, separate different frequency signals.

In accordance with one embodiment, transmission lines stub sections 28, 20 have the same impedance as transmission line sections 50, 32, although this is not a requirement as transmission lines stub sections of a different impedance may also be used. In accordance with an alternative embodiment of the present invention, the impedance of transmission lines stub sections 28, 20 may be lower than the impedance of transmission line sections 50, 32, resulting in a greater line-width for transmission lines stub sections 28, 20.

Patch antennas 48, 58 are preferably microstrip patch antennas, although any antenna that selectively receives frequencies may be suitable for use with the present invention, and provided that the desired reception frequency range of the antennas does not substantially overlap. In accordance with one embodiment, patch antenna 58 is designed to selectively receive GPS L1 frequencies, and patch antenna 48 is designed to receive GPS L2 frequencies. In the illustrated embodiment, patch antennas 48, 58 reside in a separate plane (i.e., either above or below) from other circuitry of system 60. For example, a separate dielectric layer and ground plane (not shown) may be used to separate patch antennas 48, 58 from the circuitry of system 60.

FIG. 1 is an example circuit layout of system 60 that includes signal divider/combiner 11 illustrating one of the preferred stripline embodiments. To efficiently utilize space, the various elements of system 60 are configured in a small area by, for example, fabricating the various microstrip transmission lines with curves and bends. For example, the first and second transmission line stub sections 28, 20 have several curves which allow lines of a longer length to fit into a smaller region.

Figure 2:
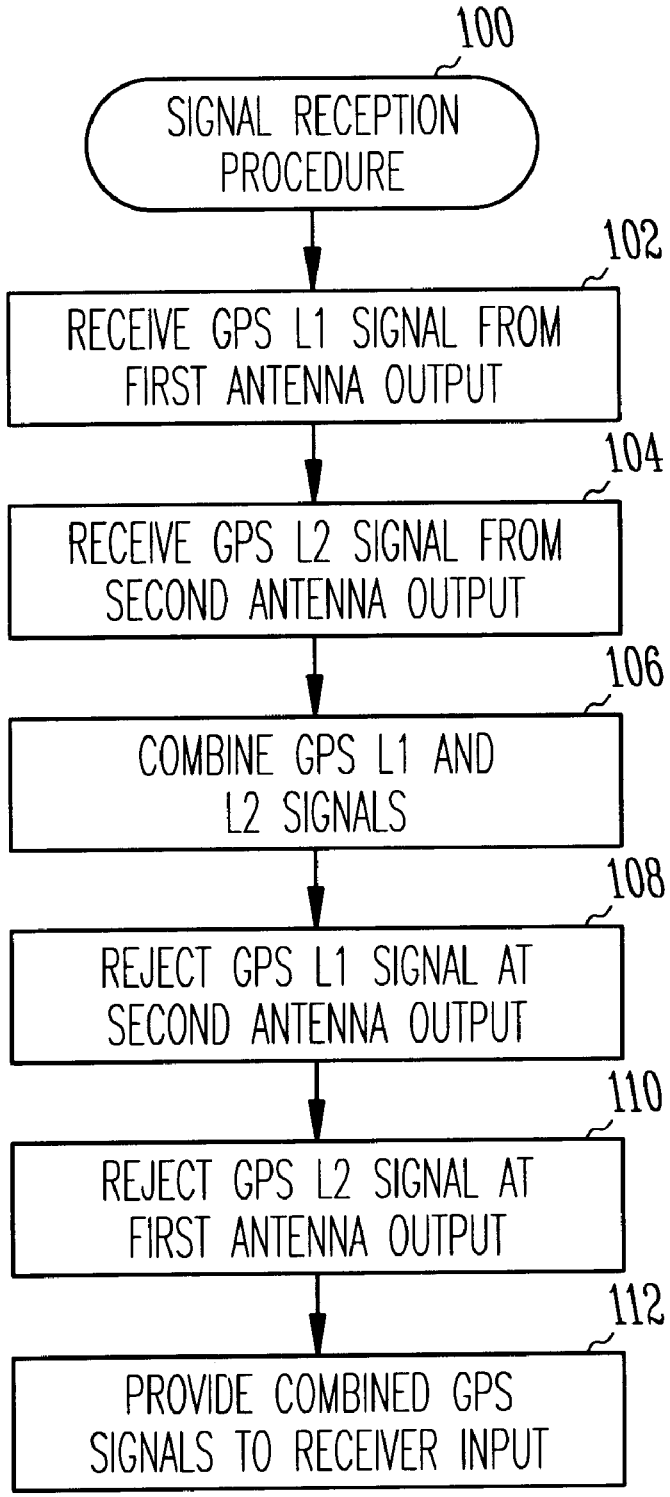
FIG. 2 illustrates a procedure for combining signals in accordance with one embodiment of the present invention.

FIG. 2 illustrates a procedure for combining signals in accordance with a preferred embodiment of the present invention. Procedure 100 may be performed by portions of the example antenna receiving system 60 (FIG. 1), as well as by other circuitry. In the various embodiments of the present invention, procedure 100 provides for, among other things, combining signals of a first and second frequency, blocking of signals of the first and second frequencies, and reducing of radiation of signals of the first and second frequencies by the opposite antenna. Although a certain sequence of tasks are illustrated in procedure 100, this is not intended to imply that the tasks must be performed in any such sequence.

In task 102, signals of the first frequency are received by a first antenna and provided to antenna receiving circuitry at a first antenna output port. In task 104, signals of the second frequency are received by a second antenna and provided to antenna receiving circuitry at a second antenna output port. In accordance with the various embodiments, the first antenna selectively receives signals of the first frequency and does not substantially receive signals of the second frequency, while the second antenna selectively receives signals of the second frequency and does not substantially receive signals of the first frequency. For example, antennas may be microstrip patch antennas tuned and designed for receiving particular frequencies, such as the GPS L1 and GPS L2 signal frequencies.

In task 106, the first and second signals provided respectively by the first and second antenna output ports traverse respectively along first and second transmission line sections and are combined in a combining junction. In task 108, the signals of the first frequency are blocked from reaching the second antenna output. Preferably, a transmission line stub section positioned along the second transmission line at a distance from the junction substantially equal to a quarter-wavelength of the first frequency rejects the signals of the first frequency at the junction. In task 110, the signals of the second frequency are blocked from reaching the first antenna output. Preferably, a transmission line stub section positioned along the first transmission line section at a distance from the junction substantially equal to a quarter-wavelength of the second frequency rejects the signals of the second frequency at the junction .

In task 112, a combined signal of the first and second frequencies are provided to a receiver input. The combined signal is preferably provided with substantially all of the signal power of both signals to the receiver input with little signal power being diverted to the opposite antenna. Accordingly, the signals at the first antenna output are substantially devoid of signals of the second frequency provided from the second antenna output, and the signals at the second antenna output are substantially devoid of signals of the first frequency provided from the first antenna output.

In another embodiment, the present invention provides a method of reducing radiation of first and second frequency signals received respectively through first and second antenna outputs. The signals are combined in a combining junction and provided to a receiver input. In this embodiment, a first transmission line stub section is positioned at a distance from the junction substantially a quarter-wavelength of the second frequency to reduce signals of the second frequency at the first antenna output. A second transmission line stub section is positioned at a distance from the junction substantially equal to a quarter-wavelength of the first frequency to reduce signals of the first frequency at the second antenna output. In this embodiment, the first and second frequencies are non-overlapping frequencies, and the first and second transmission line stub sections are preferably open-circuited stubs. The first transmission line stub section has a length substantially equal to an odd multiple number of quarter-wavelengths of the second frequency, and the second transmission line stub section has a length substantially equal to an odd multiple number of a quarter-wavelengths of the first frequency.

Thus, an improved signal divider/combiner and method of dividing/combining signals of different frequencies has been described. In accordance with the various embodiments of the signal divider/combiner and methods of the present invention, a significantly greater amount of signal energy received from input sources is transferred to an output such as a receiver input. In the case of GPS L1 and L2 signals used for position determination and bounce correction, this allows a receiver to perform faster position calculations and helps the receiver overcome noise and interference. In addition, the signal divider/combiner and method of the present invention provides for a reduction in radiation of signals through opposite antenna ports.

The foregoing description of the specific embodiments will so fully reveal the general nature of the invention that others can, by applying current knowledge, readily modify and/or adapt for various applications such specific embodiments without departing from the generic concept, and therefore such adaptations and modifications should and are intended to be comprehended within the meaning and range of equivalents of the disclosed embodiments.

It is to be understood that the phraseology or terminology employed herein is for the purpose of description and not of limitation. Accordingly, the invention is intended to embrace all such alternatives, modifications, equivalents and variations as fall within the spirit and broad scope of the appended claims.

What is claimed is:

1. A signal divider/combiner for dividing/combining signals of first and second similar narrowband frequencies comprising:

first, second and third transmission lines meeting at a junction, the first, second and third transmission lines having substantially the same impedance as each other, the first and second transmission lines having substantially the same impedance throughout their length;

a first transmission line stub section coupled to the first transmission line to substantially block signals of the second frequency along the first transmission line; and a second transmission line stub section coupled to the second transmission line to substantially block signals of the first frequency along the second transmission line, wherein the first transmission line stub section is a first open-circuit stub positioned a first distance from the junction, the first distance being substantially equal to an odd multiple number of quarter-wavelengths of the second frequency, and wherein the second transmission line stub section is a second open-circuit stub positioned a second distance from the junction, the second distance being substantially equal to an odd multiple number of quarter-wavelengths of the first frequency.

2. The signal divider/combiner as claimed in claim 1 wherein the similar frequencies are greater than 1000 MHz.

3. The signal divider/combiner as claimed in claim 2 wherein the first, second and third transmission lines and the first and second open-circuit stubs are either microstrip or stripline transmission lines, and wherein the first frequency is a Global Positioning System (GPS) L1 frequency, and the second frequency is a GPS L2 frequency.

4. The signal divider/combiner as claimed in claim 2:

wherein the first open-circuit stub has a length substantially equal to an odd multiple number of quarter-wavelengths of the second frequency, and wherein the second open-circuit stub has a length substantially equal to an odd multiple number of quarter-wavelengths of the first frequency.

5. The signal divider/combiner as claimed in claim 1 wherein the signals of the first and second frequencies are provided respectively by first and second antennas, and wherein:

the first transmission line to provide signals of the first frequency from the first antenna;

the second transmission line to provide signals of the second frequency from the second antenna; and the third transmission line to receive a combined signal of the first and second frequencies from the junction and to provide the combined signal to a receiver input.

6. The signal divider/combiner as claimed in claim 5 wherein an output of first antenna is substantially devoid of signals of the second frequency received by the second antenna, and an output of the second antenna is substantially devoid of signals of the first frequency received by a first antenna, thereby reducing radiation of signals of the first frequency by the second antenna, and radiation of signals of the second frequency by the first antenna.

7. A signal combiner for combining signals of first and second similar frequencies comprising:

a first transmission line section to provide signals of the first frequency;

a second transmission line section to provide signals of the second frequency;

a third transmission line section to form a junction with the first and second transmission line sections, the junction to combine signals of the first and second frequencies, the first, second and third transmission line sections having substantially the same impedance as each other and throughout their length;

a first transmission line stub section coupled to the first transmission line section to substantially block signals of the second frequency; and a second transmission line stub section coupled to the second transmission line section to substantially block signals of the first frequency, wherein the first transmission line stub section is a first open-circuit stub positioned a first distance from the junction, the first distance being substantially equal to an odd multiple number of quarter-wavelengths of the second frequency, and wherein the second transmission line stub section is a second open-circuit stub positioned a second distance from the junction, the second distance being substantially equal to an odd multiple number of quarter-wavelengths of the first frequency.

8. The signal combiner as claimed in claim 7 further comprising:

a first antenna output to provide signals of the first frequency along the first transmission line section, the first transmission line stub section to block signals of the second frequency along the first transmission line section reducing signals of the second frequency at the first antenna output; and a second antenna output to provide signals of the second frequency along the second transmission line section, the second transmission line stub section to block signals of the first frequency along the second transmission line section reducing signals of the first frequency at the second antenna output.

9. The signal combiner as claimed in claim 7 wherein the third transmission line section to provide combined signals of the first and second frequency from the junction to a receiver antenna input.

10. The signal combiner as claimed in claim 7 wherein the similar frequencies are greater than 1000 MHz.

11. The signal combiner as claimed in claim 7 wherein the first transmission line stub section has a length substantially equal to an odd multiple number of quarter-wavelengths of the second frequency, and wherein the second transmission line stub section has a length substantially equal to an odd multiple number of quarter-wavelengths of the first frequency.

12. The signal combiner as claimed in claim 7 wherein the junction is a "tee" junction.

13. The signal combiner as claimed in claim 7 wherein the junction is a "y" junction.

14. The signal combiner as claimed in claim 7 wherein the first, second and third transmission line sections and the first and second transmission line stub sections are stripline transmission lines.

15. The signal combiner as claimed in claim 7 wherein the first, second and third transmission line sections and the first and second transmission line stub sections are microstrip transmission lines.

16. The signal combiner as claimed in claim 7 wherein the first frequency is a Global Positioning System (GPS) L1 frequency, and the second frequency is a GPS L2 frequency.

17. An antenna receiving system for receiving signals of first and second similar frequencies comprising:

a 180-degree hybrid in the form of a transmission line ring to phase shift and combine signals of the first frequency received by a first antenna;

a common transmission line section to provide signals of the first and second frequency to a receiver input;

a first transmission line section coupled between the 180-degree hybrid and the common transmission line section;

a first transmission line stub section coupled to the first transmission line section to reduce propagation of signals of the second frequency along the first transmission line section;

a second transmission line section to provide signals of the second frequency from a second antenna, the second transmission line section coupled to the common transmission line section, and a second transmission line stub section coupled to the second transmission line section to reduce propagation of signals of the first frequency along the second transmission line section, wherein the first, second and common transmission lines have substantially the same impedance as each other and throughout their length, wherein ends of the first and second transmission line sections form a junction with an end of the common transmission line section;

wherein the first transmission line stub section is positioned a first distance from the junction, the first distance being substantially equal to an odd multiple number of quarter-wavelengths of the second frequency, and the second transmission line stub section is positioned a second distance from the junction, the second distance being substantially equal to an odd multiple number of quarter-wavelengths of the first frequency.

18. The antenna receiving system as claimed in claim 17 further comprising:

a first 90-degree hybrid to combine signals of the second frequency received by the second antenna and coupled with the second transmission line section.

19. The antenna receiving system as claimed in claim 18 further comprising second and third 90 degree hybrids to phase shift and combine a plurality of signals from the first antenna and provide combined signals to the 180 degree hybrid.

20. The antenna receiving system as claimed in claim 19 wherein the first antenna is a microstrip patch antenna to receive Global Positioning System (GPS) L1 frequency signals, and the second antenna is a microstrip patch antenna to receive GPS L2 frequency signals.

21. The antenna receiving system as claimed in claim 20 wherein the transmission line ring, the first, second and third hybrids, the common transmission line section, the first and second transmission line sections and the first and second transmission line stub sections are comprised of either microstrip or stripline transmission lines, the common transmission line section.

22. The antenna receiving system as claimed in claim 1 wherein the first transmission line stub section is an open-circuit stub section having a length substantially equal to an odd multiple number of quarter-wavelengths of the second frequency, and wherein the second transmission line stub section is an open-circuit stub section having a length substantially equal to an odd multiple number of quarter-wavelengths of the first frequency.

* * * * *